US006684783B2

(12) United States Patent
Salvestro

(10) Patent No.: US 6,684,783 B2
(45) Date of Patent: Feb. 3, 2004

(54) METHOD FOR IMAGING A MEDIA SLEEVE ON A COMPUTER-TO-PLATE IMAGING MACHINE

(75) Inventor: Aldo Salvestro, Burnaby (CA)

(73) Assignee: Creo Inc., Burnaby (CA)

( * ) Notice: Subject to any disclaimer, the term of this patent is extended or adjusted under 35 U.S.C. 154(b) by 0 days.

(21) Appl. No.: 09/930,985

(22) Filed: Aug. 17, 2001

(65) Prior Publication Data

US 2003/0033949 A1 Feb. 20, 2003

(51) Int. Cl.[7] ..... B41N 6/00

(52) U.S. Cl. ..... 101/401.1; 101/375; 101/378; 492/21; 492/49

(58) Field of Search ..... 101/401.1, 375, 101/395, 378, 217; 29/895.23; 492/46, 49, 21

(56) References Cited

U.S. PATENT DOCUMENTS

| | | | | | |
|---|---|---|---|---|---|
| 3,378,902 | A | | 4/1968 | Hoexter | |
| 3,388,916 | A | | 6/1968 | Winnen et al. | |
| 3,982,312 | A | * | 9/1976 | Finzer | 492/48 |
| 4,089,265 | A | | 5/1978 | White et al. | |
| 4,381,709 | A | | 5/1983 | Katz | |
| 4,383,483 | A | | 5/1983 | Moss | |
| 4,386,566 | A | | 6/1983 | Moss | |
| 4,503,769 | A | | 3/1985 | Andersen | |
| 4,651,643 | A | | 3/1987 | Katz et al. | |
| 4,794,858 | A | | 1/1989 | Katz | |
| 4,903,597 | A | * | 2/1990 | Hoage et al. | 101/375 |
| 4,917,013 | A | * | 4/1990 | Katz | 101/375 |
| 5,168,808 | A | | 12/1992 | Prem | |
| 5,370,047 | A | | 12/1994 | Compton | |
| 5,507,228 | A | * | 4/1996 | Schulz | 101/375 |
| 5,544,584 | A | * | 8/1996 | Thompson et al. | 101/375 |
| 5,798,019 | A | * | 8/1998 | Cushner et al. | 156/187 |
| 5,868,075 | A | * | 2/1999 | Kline et al. | 101/467 |
| 5,904,095 | A | | 5/1999 | Nelson | |
| 5,925,500 | A | * | 7/1999 | Yang et al. | 430/273.1 |
| 6,161,478 | A | | 12/2000 | Katz | |
| 6,186,068 | B1 | * | 2/2001 | Gelbart | 101/486 |
| 6,360,662 | B1 | * | 3/2002 | Busshoff | 101/216 |
| 6,401,613 | B1 | * | 6/2002 | Gayle et al. | 101/375 |
| 6,425,327 | B1 | * | 7/2002 | Fan et al. | 101/375 |
| 6,520,083 | B2 | * | 2/2003 | Petersen et al. | 101/401.1 |
| 6,546,867 | B1 | * | 4/2003 | Franklin et al. | 101/378 |

* cited by examiner

*Primary Examiner*—Andrew H. Hirshfeld
*Assistant Examiner*—Dave A. Ghatt
(74) *Attorney, Agent, or Firm*—Oyen, Wiggs, Green & Mutala

(57) ABSTRACT

A computer-to-plate method and apparatus is described for imaging media sleeves by employing a laser-based imaging head in conjunction with a two stage mandrel comprising an expandable arbor and an intermediate sleeve. Most of the bulk of the mandrel is contained in the expandable arbor, which may be expanded hydraulically to mechanically engage the intermediate sleeve. The media sleeve to be imaged is mounted on the intermediate sleeve by conventional means. The method and apparatus of the invention makes possible the rapid changing between different sizes of media sleeves without requiring the handling of bulky mandrels and without endangering the precision optics imaging head of the apparatus, while maintaining the mounting precision.

43 Claims, 1 Drawing Sheet

METHOD FOR IMAGING A MEDIA SLEEVE ON A COMPUTER-TO-PLATE IMAGING MACHINE

CROSS-REFERENCES TO RELATED APPLICATIONS none

STATEMENT REGARDING FEDERALLY SPONSORED R&D

Not applicable

REFERENCE TO MICROFICHE APPENDIX

Not applicable

FIELD OF THE INVENTION

The invention pertains to printing and more particularly to digital imaging of media sleeves, a field also known as Computer-to-Plate imaging.

BACKGROUND OF THE INVENTION

In many types of printing, particularly flexographic printing, offset printing, gravure printing and screen-printing, there is an advantage in using media sleeves as printing elements instead of plates wrapped around printing cylinders. Media sleeves, in the form of seamless sleeves, allow printing of continuous patterns. The use of media sleeves in general allows printing presses to operate with faster printing job turnover.

However, before a media sleeve can be mounted on a printing press, it first has to be imaged and processed, although some materials are available today that do not require processing. Prior art imaging devices for imaging such media sleeves were built in the general form of a lathe. Such machines have a mandrel on which a media sleeve can be mounted, a fixed headstock for driving the media sleeve, a moveable tailstock for supporting the media sleeve, and a traveling imaging head. In these systems the traveling tailstock typically moves on tracks in order to accommodate sleeves of different lengths.

Presses are often equipped with a cylinder of a fixed size, or have a cylinder-mandrel arrangement that allows media sleeves of differing diameter to be accommodated by mounting a different cylinder on the press. A single imaging machine typically serves a number of different presses. As a result media sleeve sizes have to be changed more often on an imaging machine than on a press. The changing of the cylinder-mandrels is therefore a major problem on the imaging machines, where the changes are frequent, and the cumbersome changing process, characterized by the extensive handling of bulky and heavy cylinder-mandrels, becomes a major operational bottleneck.

On a typical imaging machine, replacing a media sleeve involves removing the cylinder-mandrel from the exposure machine and removing the media sleeve from the cylinder-mandrel. Typically the media sleeve is removed from the mandrel by connecting a pneumatic supply to the cylinder-mandrel and pressurizing the inside, causing air to leak out from small holes under the media sleeve. Such airflow expands the media sleeve and creates an air bearing, allowing the media sleeve to slide off the cylinder-mandrel and be replaced by another sleeve to be imaged.

In the field of computer-to-plate (CTP) imaging, lasers are employed to image the media sleeves. The generally high imaging performance of these systems is achieved through comparatively intricate optical arrangements involving laser arrays and/or a variety of light modulation devices such as light valves. These arrangements often result in stringent requirements on the tracking, alignment and, in particular, focus between the media sleeve and the imaging head.

The excessive mounting, demounting and handling of heavy mandrels is therefore not only an operational bottleneck, but also presents a mechanical danger to, what is in reality, a precision optics machine. It is furthermore important that the media sleeves, when mounted on the mandrels, should rotate as perfectly as possible without any run-out or vibrations, in order to facilitate optimal imaging by the precision optics head.

A typical imaging machine therefore is subject to a higher frequency of media sleeve changes than a typical press served by the same imager, whilst also having to maintain very high optical precision. Clearly the media sleeve mounting requirements of an imaging machine present rather different challenges from those of mounting the imaged media sleeve on a press, and there is therefore a requirement for an arrangement and method that can limit the handling of bulky mandrels and yet maintain the accuracies demanded by the precision optics of the imaging machine.

Prior art computer-to-plate imagers are based on the changing of entire bulky mandrels in order to facilitate a change in media sleeve diameter. While various mandrel arrangements have been proposed for machine tools and presses, these have not addressed the rapid interchangeability and precision needs of the latest generation of computer-to-plate imagers, typically equipped with laser-based imaging heads.

BRIEF SUMMARY OF THE INVENTION

The invention provides a computer-to-plate method and apparatus for imaging media sleeves by employing a laser-based imaging head in conjunction with a two-stage mandrel comprising an expandable arbor and an intermediate sleeve. Most of the bulk of the mandrel is contained in the expandable arbor, which may be expanded hydraulically in order to mechanically engage the intermediate sleeve. The media sleeve to be imaged is mounted on the intermediate sleeve by conventional means. The method and apparatus of the invention makes possible the rapid changing between different sizes of media sleeves without requiring the handling of bulky mandrels and to minimize potential damage to the precision optics imaging head of the apparatus, whilst maintaining the mounting precision.

DETAILED DESCRIPTION OF THE PREFERRED EMBODIMENT

Figure 1A:
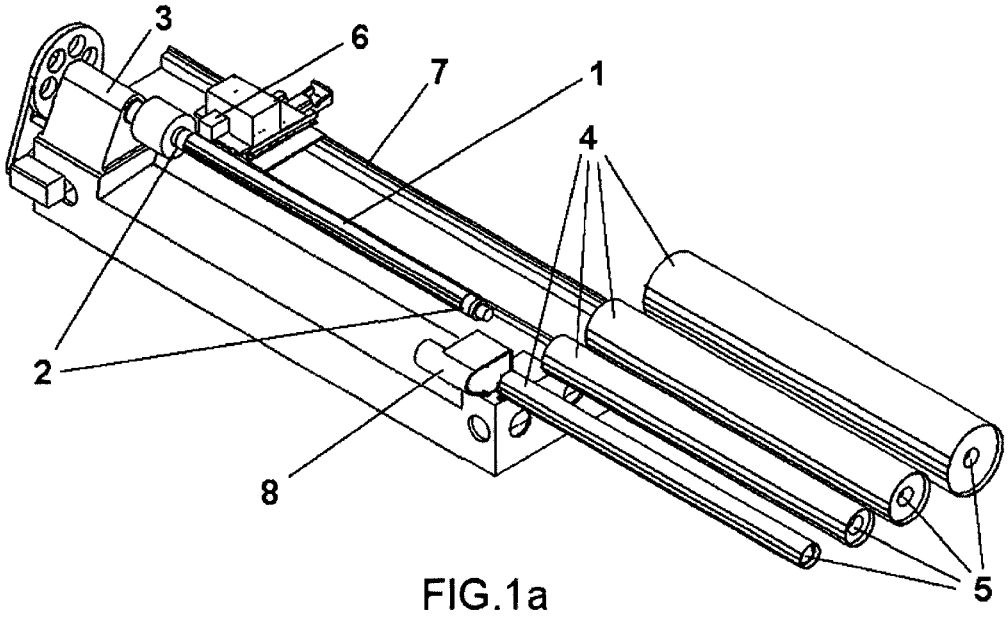
FIG. 1*a* shows the apparatus of the preferred embodiment of the present invention with a selection of unmounted intermediate sleeves.
Figure 1B:
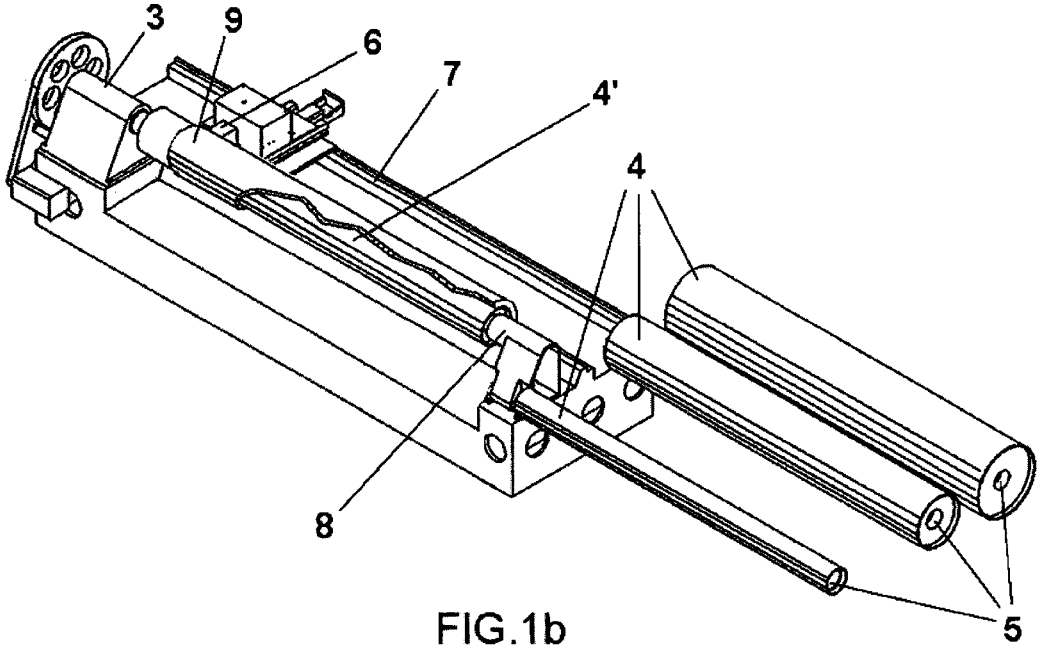
FIG. 1*b* shows the apparatus of the preferred embodiment of the present invention with a selected intermediate sleeve mounted on the expandable arbor of the apparatus.

FIG. 1*a* and FIG. 1*b* show the preferred embodiment of the present invention in the form of a computer-to-plate imager for media sleeves. In FIG. 1*a* an arbor 1 is affixed to and driven via a headstock assembly 3. Arbor 1 has radially expandable rings 2. A collection of intermediate sleeves 4, of different outside diameters and having inner surfaces 5, are shown available for mounting on arbor 1. Tailatock assembly 8 is shown here folded away to facilitate mounting of a selected intermediate sleeve. The term intermediate sleeve is used herein to describe a sleeve having an outer diameter that substantially matches the inner diameter of a media sleeve to be imaged, and an inner surface capable of engaging mechanically with arbor 1 that is disposed to facilitate the rotation of intermediate sleeves 4. The term media sleeve is used to describe any Sleeve that may be imaged.

FIG. 1*b* shows the apparatus of the preferred embodiment of the present invention in imaging mode. A selected intermediate sleeve 4' is shown mounted on arbor 1, and tailstock assembly 8 is now shown engaged with arbor 1. Rings 2 (see FIG. 1*a*) are expanded hydraulically via a supply line provided through headstock assembly 3 and engage mechanically with the inner surface of selected intermediate sleeve 4'. Media sleeve 9 (shown partly cut away for the sake of clarity) is shown mounted over selected intermediate sleeve 4' which has been selected on the basis of its outer radius substantially matching the inner radius of media sleeve 9. The process by which media sleeve 9 is mounted on selected intermediate sleeve 4' is not shown here as it is well established in the prior art and used extensively in industry.

In the preferred embodiment of the present invention the rings 2 of arbor 1 are expanded hydraulically. In an alternative embodiment of the present invention this may be achieved via a mechanical arrangement such as tapers or flexures. In yet another alternative embodiment of the present invention the same end may be achieved using a pneumatics-based arrangement. The term cylinder-mandrel is used herein to describe the combined arbor and intermediate sleeve, the cylinder-mandrel of the present invention thereby comprising two mechanically engaging stages.

In the preferred embodiment of the present invention arbor 1 is expanded at its two rings 2 to mechanically engage selected intermediate sleeve 4'. In an alternative embodiment of the present invention, more areas of the arbors may be expanded, and the areas may comprise any subsection of the arbor so disposed as to mechanically engage a suitably shaped inner surface of selected intermediate sleeve 4'. The expandable area may also be chosen to be one single large area. The term radially outward expandable portion is used to describe any such expandable portion of arbor 1.

In a specific alternative embodiment, the radially outward expandable portions 2 of arbor 1 are located to coincide substantially with the Airy points of selected intermediate sleeve 4'. These points are located approximately 22% of the length inward from either end of selected intermediate sleeve 4'. Practitioners in the field will appreciate that, by mechanically supporting selected intermediate sleeve 4' at these particular points, intermediate sleeve 4' will be subject to the least flexure, thereby making the least demand on the actuating arrangement (not shown) of imagewise controllable radiation source 6, which otherwise has to adapt the optics of radiation source 6 to the variation in the distance between the surface of media sleeve 9 and radiation source 6.

In the embodiment of the invention illustrated in FIGS. 1*a* and 1*b*, imaging head C, traveling on track 7 along the length of media sleeve 9, images media sleeve S under the control of a control unit (not shown). By rotating media sleeve 9 whilst traversing imaging head 6, the entire surface of media sleeve s may be imaged. In the preferred embodiment of the present invention, the imaging head comprises an imagewise addressable laser array operating in the near infrared, preferably near 830 nm, and media sleeve 9 is an ablatable digital flexographic sleeve.

The term imagewise controllable radiation source is used herein to describe an imaging head of which the radiation source is chosen to match a media being imaged on media sleeve 9. In alternative embodiments, the media sleeve may be a gravure sleeve or a screen-printing sleeve or a lithographic sleeve. The media sleeve may be imageable via ablation or may employ an alternative imaging technology, and imaging may be followed by subsequent processing before use on a press. In alternative embodiments imaging heads may use alternative radiation sources, including non-laser sources combined with a light valve device, in order to image the media sleeve. Radiation source wavelengths of choice for alternative embodiments of the present invention include 1064 nm, corresponding to the use of YAG lasers, and 10.6 microns, corresponding to the use of $CO_2$ lasers.

In an alternative embodiment of the present invention, the inner diameter of media sleeve 9 may not substantially match the outer diameter of selected intermediate sleeve 4'. In this particular embodiment of the present invention, a buildup sleeve is placed around selected intermediate sleeve 4' to obtain an outer diameter that does substantially match the inner diameter of media sleeve 9. Buildup sleeves are well known to practitioners in the field and standard in the art and require no further description here.

The material of choice for intermediate sleeves 4 is governed by the need to be stiff enough to support media sleeve 9. A variety of materials, including by way of example composite materials, may be employed to maximize the weight benefits of the present invention. All the heavy aspects of the cylinder-mandrel, such as journals, are thereby contained within arbor 1, allowing intermediate sleeves 4 to be lightweight.

There has thus been outlined the important features of the invention in order that it may be better understood, and in order that the present contribution to the art may be better appreciated. Those skilled in the art will appreciate that the conception on which this disclosure is based may readily be utilized as a basis for the design of other methods and apparatus for carrying out the several purposes of the invention. It is most important, therefore, that this disclosure be regarded as including such equivalent methods and apparatus as do not depart from the spirit and scope of the invention.

What is claimed is:

1. A method for imaging a media sleeve, said method comprising:

a) mounting said media sleeve on a cylinder-mandrel, said cylinder-mandrel comprising
   i) an arbor comprising at least one radially outward expandable portion,
   ii) an intermediate sleeve with outer radius substantially equal to the inner radius of said media sleeve, b) mechanically engaging the inner radial surface of said intermediate sleeve with said arbor by radially expanding at least one portion of said arbor, and c) while said portion of said arbor is radially expanded, imaging said media sleeve on said mandrel using an imagewise controllable radiation source.

2. A method as in claim 1, said imagewise controllable radiation source comprising a laser.

3. A method as in claim 2, wherein said laser is one of a near-infrared laser, a YAG laser, and a $CO_2$ laser.

4. A method as in claim 1, wherein said expanding is done hydraulically.

5. A method as in claim 1, wherein said expanding is done pneumatically.

6. A method as in claim 1, wherein said expanding is done mechanically.

7. A method as in claim 1, wherein radially expanding at least one portion of said arbor comprises radially expanding a ring to contact said intermediate sleeve at an Airy point of said intermediate sleeve.

8. A method as in claim 1, wherein said media sleeve is a seamless sleeve.

9. A method as in claim 1, wherein said media sleeve is one of a flexographic sleeve and a gravure sleeve.

10. A method as in claim 1, wherein radially expanding at least one portion of said arbor comprises radially expanding a plurality of rings such that each of the plurality of rings respectively contacts said intermediate sleeve at a respective Airy point of said intermediate sleeve.

11. An apparatus for imaging a media sleeve, said apparatus comprising a) a cylinder-mandrel disposed to mount said media sleeve, said cylinder-mandrel comprising i) an arbor comprising at least one radially outward expandable portion, ii) an intermediate sleeve having an cuter radius substantially equal to the inner radius of said media sleeve and having an inner radial surface configured to engage mechanically with said at least one expandable portion of said arbor, the intermediate sleeve being removable from the arbor while said at least one expandable portion is not radially expanded, and b) an imagewise controllable radiation source disposed to image said media sleeve mounted on said cylinder-mandrel.

12. An apparatus as in claim 11, wherein said imagewise controllable radiation source comprises a laser.

13. An apparatus as in claim 12, wherein said laser is one of a near-infrared laser, a YAG laser and a $CO_2$ laser.

14. An apparatus as in claim 11, wherein said at least one expandable portion is actuated hydraulically.

15. An apparatus as in claim 11, wherein said at least one expandable portion is actuated pneumatically.

16. An apparatus as in claim 11, wherein said at least one expandable portion is actuated mechanically.

17. An apparatus as in claim 11, wherein said at least one expandable portion comprises an expandable ring disposed to make contact with one Airy point of said intermediate sleeve.

18. An apparatus as in claim 11, wherein said media sleeve is a seamless sleeve.

19. An apparatus as in claim 11, wherein said media sleeve is one of a flexographic sleeve and a gravure sleeve.

20. An apparatus as in claim 11, wherein said at least one expandable portion comprises a plurality of expandable rings, each of the plurality of rings being respectively disposed to make contact with one respective Airy point of said intermediate sleeve.

21. A cylinder-mandrel for imaging a media sleeve on a computer-to-plate imaging machine, said cylinder-mandrel comprising a) an arbor, said arbor being expandable radially with respect to an axis of rotation at a plurality of locations spaced axially apart along an outer surface of said arbor, b) an intermediate sleeve having i) an outer radius substantially equal to the inner radius of said media sleeve and ii) an inner surface configured to engage mechanically with said at least one expandable portion of said arbor, wherein the intermediate sleeve is removable from the arbor while said arbor is not expanded radially.

22. A cylinder-mandrel for imaging a media sleeve on a computer-to-plate imaging machine as in claim 21, said arbor being hydraulically expandable.

23. A cylinder-mandrel for imaging a media sleeve on a computer-to-plate imaging machine as in claim 21, said arbor being pneumatically expandable.

24. A cylinder-mandrel for imaging a media sleeve on a computer-to-plate imaging machine as in claim 21, said arbor being mechanically expandable.

25. A method for imaging a media sleeve on a computer-to-plate imaging machine, said media sleeve being one of a plurality of media sleeves of different inner diameters, said method comprising:

a) mounting an intermediate sleeve on an arbor, b) mounting said media sleeve on said intermediate sleeve, c) expanding the radial extent of at least one portion of the radial surface of said arbor to engage mechanically said intermediate sleeve, and d) imaging said media sleeve with an imagewise controllable radiation source while rotating said media sleeve and said intermediate sleeve on said arbor while said at least one portion of the radial surface of said arbor is expanded.

26. A method as in claim 25, wherein said imagewise controllable radiation source comprises a laser.

27. A method as in claim 26, wherein said laser is one of a near-infrared laser, a YAG laser and a $CO_2$ laser.

28. A method as in claim 25, wherein said expanding is done hydraulically.

29. A method as in claim 25, wherein said expanding is done pneumatically.

30. A method as in claim 25, wherein said expanding is done mechanically.

31. A method as in claim 25, wherein expanding the radial extent of at least one portion of the radial surface of said arbor comprises expanding the radial extent of a radially expandable ring disposed to contact an Airy point of said intermediate sleeve.

32. A method as in claim 25, wherein expanding the radial extent of at least one portion of the radial surface of said arbor comprises expanding the radial extent of a plurality of radially expandable rings, each of the plurality of rings being respectively disposed to contact a respective Airy point of said intermediate sleeve.

33. A method for imaging a media sleeve on a computer-to-plate imaging machines said media sleeve being one of a plurality of media sleeves of different inner diameters, said method comprising:

mounting an intermediate sleeve on an arbor, mounting said media sleeve on said intermediate sleeve, expanding the radial extent of at least one portion of the radial surface of said arbor to engage mechanically said intermediate sleeve, imaging said media sleeve with an imagewise controllable radiation source while rotating said media sleeve and said intermediate sleeve on said arbor, and selecting said intermediate sleeve from a plurality of intermediate sleeves, the members of said plurality of intermediate sleeves having external diameters substantially matching the inner diameters of members of said plurality of media sleeves.

34. A method for imaging a media sleeve on an imaging device comprising a) providing a media sleeve having an internal diameter;

b) selecting from a plurality of intermediate sleeves having different external diameters an intermediate sleeve having an external diameter which substantially matches the internal diameter of the media sleeve;

c) removably mounting said media sleeve on said intermediate sleeve;

d) detachably mounting the selected intermediate sleeve on an expandable arbor;

e) imaging said media sleeve while rotating said media sleeve and said intermediate sleeve by rotating said expandable arbor.

35. A method as in claim 34, wherein said removable mounting is done by expanding at least one portion of said arbor.

36. A method as in claim 35, wherein said expanding is done hydraulically.

37. A method as in claim 35, wherein said expanding is done pneumatically.

38. A method as in claim 35, wherein said expanding is done mechanically.

39. A method as in claim 34, wherein said imaging is done with an imaging head comprising at least one laser.

40. A method as in claim 39, wherein said laser is one of a near-infrared laser, a YAG laser and a $CO_2$ laser.

41. A method as in claim 34, wherein said media sleeve is a seamless sleeve.

42. A method as in claim 34, wherein said media sleeve is one of a flexographic sleeve and a gray-are sleeve.

43. A method for imaging a media sleeve on a computer-to-plate imaging machine, said media sleeve being one of a plurality of media sleeves of different inner diameters, said method comprising a) mounting an intermediate sleeve on an arbor, b) mounting a buildup sleeve on said intermediate sleeve, c) mounting said media sleeve on said buildup sleeve, d) expanding the radial extent of at least one portion of the radial surface of said arbor to engage mechanically said intermediate sleeve and e) imaging said media sleeve with an imagewise controllable radiation source while rotating said media sleeve on said arbor while said at least one portion of the radial surface of said arbor is expanded.

* * * * *